United States Patent [19]

LaChance

[11] Patent Number: 4,834,002

[45] Date of Patent: May 30, 1989

[54] BURNING APPARATUS AND METHOD

[76] Inventor: Robert E. LaChance, Rte. 2, Box 116E, Rougemont, N.C. 27572

[21] Appl. No.: 115,771

[22] Filed: Oct. 30, 1987

[51] Int. Cl.[4] ..... F23G 7/04

[52] U.S. Cl. ..... 110/346; 126/271.1; 98/36

[58] Field of Search ..... 110/346, 239, 240, 241; 126/271.1, 271.2 R; 98/36

[56] References Cited

U.S. PATENT DOCUMENTS

| | | | |
|---|---|---|---|
| 2,012,521 | 8/1935 | Rognerud | 126/271.1 |
| 2,273,254 | 2/1942 | Davis | 126/271.2 A |
| 2,618,508 | 11/1952 | Daugherty . | |
| 2,635,920 | 4/1953 | Boyce . | |
| 2,770,070 | 11/1956 | Funk . | |
| 3,227,376 | 1/1966 | Rittenhouse . | |
| 3,489,351 | 1/1970 | Patterson . | |
| 3,773,000 | 11/1973 | Applegate | 98/36 |
| 3,878,989 | 4/1975 | Jenkins . | |
| 3,883,073 | 5/1975 | Ballu . | |
| 4,405,337 | 9/1983 | Mori . | |
| 4,516,723 | 5/1985 | Hesse . | |
| 4,539,014 | 9/1985 | Sweeney . | |
| 4,739,712 | 4/1988 | McPherson | 98/36 |

*Primary Examiner*—James C. Yeung
*Attorney, Agent, or Firm*—Richard E. Jenkins

[57] ABSTRACT

A burning apparatus and method particularly adapted for burning land clearing debris and comprising a transportable frame carrying an air blower and a remotely located spray nozzle. The apparatus facilitates complete combustion of the debris by directing an air flow thereon and by selectively providing a spray of flammable fuel thereon wherein said flammable is most suitably a solution of motor oil and diesel fuel.

1 Claim, 3 Drawing Sheets

BURNING APPARATUS AND METHOD

TECHNICAL FIELD

The present invention relates to a burning apparatus and method. More particularly, the present invention relates to a brush pile burning apparatus and method which provides for rapid, complete and economical burning of land clearing debris and the like.

BACKGROUND ART

New construction of office buildings, homes and other structures typically begins with clearing the land upon which the new structure is to be built. This land clearing often results in the accumulation of large piles of trees, tree stumps, branches and other foliage which must be disposed of before construction can begin. Traditionally, the piles of brush have been ignited so as to create a large fire in order to destroy the pile of debris. The traditional method many times requires the digging of extensive trenches in order to control the blaze created by the fire. Also, any newly cut trees or branches should be allowed to dry for several days or weeks, depending on the weather, in order to insure their suitability for burning. However, this is not always possible and an effort must be made to burn the green debris. With either green or dry debris, portions of the debris often remain unburned and present difficulties to those preparing to build on the cleared site.

Various flammable fluids and mixtures have been utilized, with little success, to enhance the burning of the debris. Many fluids are too volatile and evaporate or run off into the ground so that the flame enhancing effect is short-lived. Other fluids are simply too expensive to justify their use in land clearing applications. A fluid that is both economical and efficient for this use has yet to be developed.

It is also known to utilize motorized blowers adjacent the burning debris for enhanced combustion. However, these devices are expensive and have not been widely accepted in the construction trade to date.

The apparatus and method of the present invention overcome the shortcomings of traditional brush burning methods by providing an economical apparatus and method for quickly and completely burning piles of land clearing debris.

DISCLOSURE OF THE INVENTION

In accordance with the present invention, applicant provides an apparatus and method for burning land clearing debris which enable the user to direct an air current over burning debris while selectively spraying a surprisingly suitable combination of flammable fuel onto the burning debris.

The apparatus of the present invention comprises a portable frame, a blower means for creating an air current, a first motor means for powering the blower means, a tank for the flammable solution and pump means for pumping the flammable solution, a second motor means for powering the pump means, and a spray means for spraying the flammable solution pumped from the tank onto a selected site.

The blower means is securely attached to the portable frame and comprises a fan secured within a venturi-like shroud. The fan is affixed to a drive shaft which is driven by the first motor means through a conventional belt and pulley drive. The spray means comprises a directable nozzle which is connected to the pump means by a conduit and extends forwardly of the apparatus. The pump means is powered by the second motor means, and both the first and second motor means are fluidly connected to a remote fuel tank. The tank for the flammable solution is fluidly connected to the pump means so that the flammable solution can be pumped therefrom and through the spray means upon operation of the second motor means. The first and second motor means independently and selectively operate the fan and the pump means, respectively, so that a burning pile can be aerated and/or sprayed, as needed, to assure fast and complete burning of land clearing debris.

The method of the present invention comprises directing an air current from a blower onto a burning pile of debris while selectively spraying a flammable fluid onto the burning pile. It has unexpectedly been found that a flammable fluid comprising about 60 to 90 percent by weight of used motor oil and about 10 to 40 percent by weight of diesel fuel will adhere to the pile of burning debris when sprayed thereon and thereby facilitate the combustion of the debris. The motor oil/-diesel fuel mixture is inexpensive and has been found to be uniquely effective in stimulating combustion of the burning pile. By applying the fluid to a burning pile of debris, as needed, in combination with the air current, the entire pile of debris can be completely combusted in a short period of time and thereby avoid the troublesome disposal of unburned debris. The pile of debris is so thoroughly burned that it leaves only a residue of potash which can beneficially be mixed with topsoil adjacent the burn site. The present method eliminates the need for drying piles of newly cut trees, stumps, branches and the like before burning and, very importantly, effectively controls the fire so as to avoid the need for extensive fire containment trench digging.

It is therefore an object of the present invention to provide an apparatus and method which effectuates the faster and safer burning of land clearing debris and the like.

More specifically, it is an object of the present invention to provide an apparatus and method for burning land clearing debris that is so effective as to completely eliminate unburned debris.

Another object of the present invention is to provide an apparatus and method for burning land clearing debris that is both inexpensive and expeditious.

Still another object of the present invention is to provide an apparatus and method for burning land clearing debris which avoids the need for extensive trench digging for either fire containment or residue burial purposes.

Yet another object of the present invention is to provide an apparatus and method of burning land clearing debris which is effective in facilitating the complete burning of newly cut trees, stumps and the like.

BRIEF DESCRIPTION OF THE DRAWINGS

Some of the objects of the invention having been stated, other objects will become evident as the description proceeds when taken in connection with the accompanying drawings, in which.

BEST MODE FOR CARRYING OUT THE INVENTION

Figure 1:
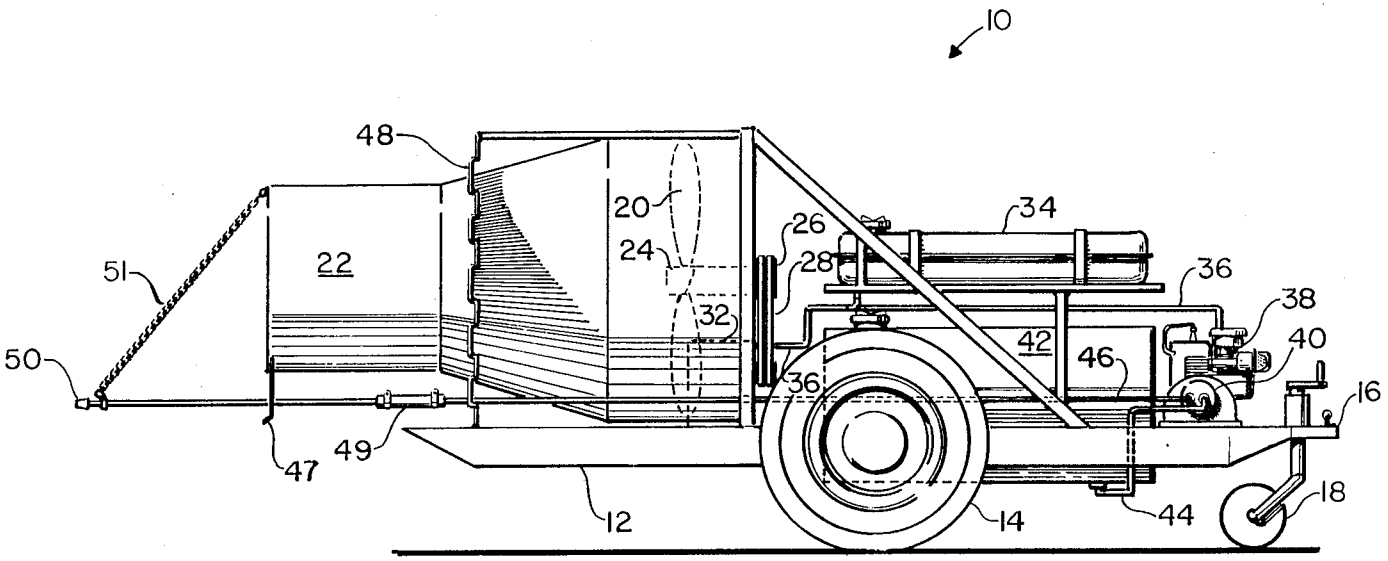
FIG. 1 is a side elevation view of the burner apparatus of the present invention.

Referring now more specifically to the drawings, a preferred embodiment of the burner apparatus of the present invention is shown in FIGS. 1–4. With specific reference now to FIG. 1, the burner apparatus 10 is shown supported by frame 12 having two pneumatic wheels 14 and a hitch 16 for attachment to transportation vehicles such as tractors, bulldozers or trucks. Support wheel 18 at the rear of frame 12 prevents frame 12 from touching the ground when hitch 16 is detached from a towing vehicle.

Figure 2:
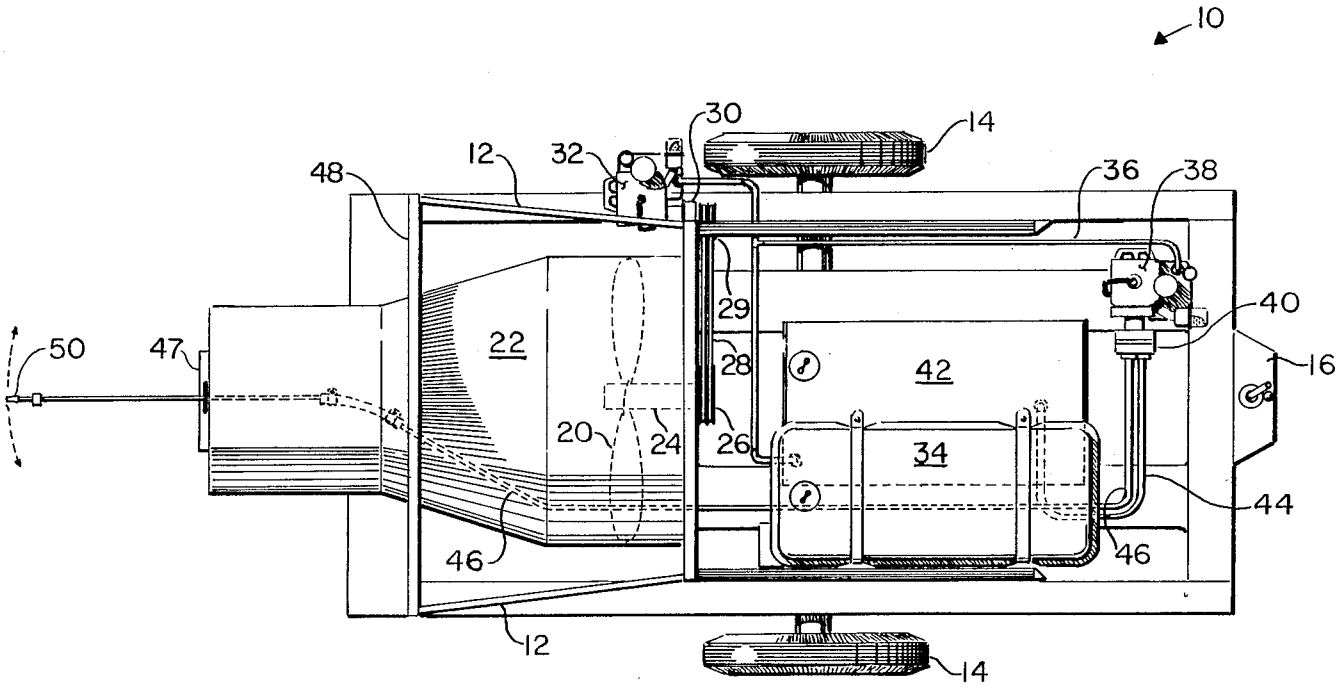
FIG. 2 is a top plan view of the burner apparatus of the present invention.
Figure 4:
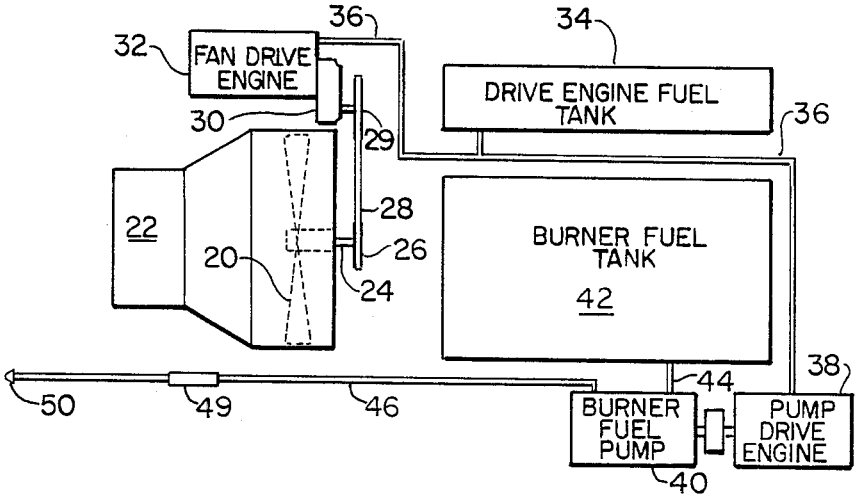
FIG. 4 is a schematic representation of the burner apparatus of the present invention.

In order to more clearly describe the essential parts of burner apparatus 10, reference is now particularly made to FIGS. 2 and 4. Fan 20 is shown rotatably supported within shroud 22 by shaft 24. Shroud 22 is shaped so as to increase the velocity of an air current blown by fan 20 outwardly through the front end of shroud 22. Shaft 24 has a pulley 26 attached thereto and pulley 26 is engaged by drive belt 28 which also engages pulley 29 secured to reduction gear 30. Reduction gear 30 is operably connected to fan drive engine 32.

Figure 3:
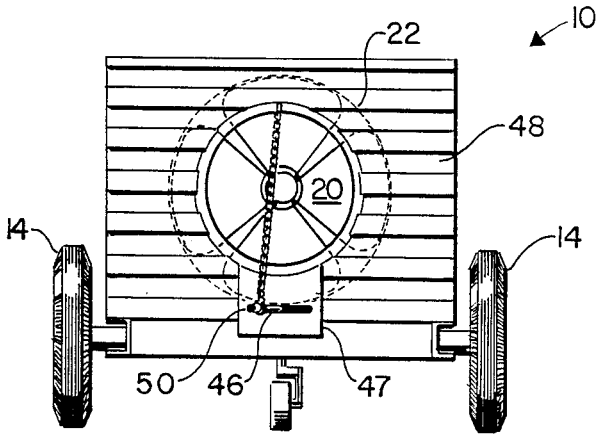
FIG. 3 is a front elevation view of the burner apparatus of the present invention.

Fan drive engine 32 is supplied with fuel from drive engine fuel tank 34 through fuel line 36 which also supplies pump drive engine 38 with fuel. Fuel pump 40 is operably connected to and driven by pump drive engine 38. Fuel tank 42 supplies fuel pump 40 with a flammable fuel mixture, preferably used motor oil and diesel fuel, by way of fuel line 44. Conduit 46 is fluidly connected to fuel pump 40 and extends beyond shroud 22 to the forward end of burner apparatus 10. As shown in FIGS. 1 and 3, conduit 46 is supported by a support plate 47 and a heat shield 48 which is attached to and surrounds shroud 22. As best shown in FIGS. 2 and 4, conduit 46 has a flexible joint 49 which allows for lateral and vertical manipulation of a nozzle 50 located at the terminal end of conduit 46 and supported by chain 51. It should be appreciated that nozzle 50 is adapted for selective spraying of the flammable fuel from fuel tank 42 generally outwardly from apparatus 10 and that the flammable fuel spray would not be introduced into the air current being created by fan 20 and directed outwardly therefrom by shroud 22.

Although other design choices are possible, applicant has found that most suitably apparatus 10 utilizes a 6 or 7 horsepower gasoline engine for fan drive engine 32 and a 3.5 horsepower gasoline engine for fuel pump engine 38. Drive engine fuel tank 34 has a 30 gallon capacity, and flammable fuel tank 42 has a 55 gallon capacity. Apparatus 10 will run for about 16 hours in ordinary use without having to refill either tank 34 or tank 42.

In operation, fan drive engine 32 drives reduction gear 30 which causes pulley 29 to rotate and thereby motivate drive belt 28 which in turn rotates pulley 26. The rotation of pulley 26 causes shaft 24 to rotate fan 20 and thereby create an air current within shroud 22. The air current within shroud 22 is increased in velocity by the venturi-like configuration thereof and the resulting air flow is projected outwardly from apparatus 10. Fuel tank 34 supplies fuel to fan drive engine 32. Independently of fan drive engine 32, pump drive engine 38 drives fuel pump 40 to pump the flammable fuel mixture from burner fuel tank 42 through conduit 46 and out nozzle 50 in the form of a spray. Pump 40 supplies sufficient pressure to project the flammable fuel onto a burning pile of debris most preferably located about ten feet from apparatus 10. The flammable fuel is not normally introduced into the air being blown from shroud 22, but is directed as needed on selected portions of the burning debris. The air current and spray are used independently of each other to best control the blazing pile of debris. In other words, drive engines 32 and 38 are separately controlled by the operator of apparatus 10 so as to utilize air flow, flammable fluid spray, and the combination thereof, as needed, to best facilitate safe, quick and complete combustion.

The method of the present invention includes initially spraying a small portion of the center of the pile of debris to be burned with a motor oil/diesel fuel mixture and then igniting the debris. The fuel mixture contains from about 60 percent to about 90 percent by weight motor oil, preferably used, and from about 10 percent to about 40 percent by weight diesel fuel. The mixture most preferably contains 80 percent used motor oil and 20 percent diesel fuel. This particular fuel mixture has unexpectedly been found to be extremely effective in stimulating combustion since the mixture adheres or sticks to the debris and therefore extends the flame-enhancing effect when compared to previous fuels utilized (such as gasoline, kerosene or diesel fuel) which tend to either evaporate or run off the debris onto the ground. A solution of 100 percent motor oil is not useful either since it provides inadequate combustion and tends to clog the spray nozzle.

Once the flame has been initiated, the air current from fan 20 is utilized to fan the flame and supply oxygen needed for combustion. The flammable spray is thereafter selectively utilized to boost the fire and further stimulate the complete burning of the pile of debris to only a potash residue. The burner apparatus can be effectively moved around the pile of debris by a transportation vehicle so as to spray and blow air onto any portion of the debris pile as may be necessary. This method of burning land clearing debris has been found to be quick, and the special flammable fuel mixture causes the entire debris, including newly cut trees and stumps, to be burned to completion so effectively that the debris is converted into only a potash residue which can beneficially be mixed into the topsoil. The sticky fuel mixture also allows the fire to be controlled and maintained within set boundaries so as to avoid the digging of trenches and the like as known to those familiar with this art. Since up to 90 percent of the flammable mixture utilized can be used motor oil, the mixture is very inexpensive to obtain. Moreover, used motor oil is a nuisance to dispose of and the present invention is a constructive method to dispose of used motor oil which might otherwise be a health hazard and costly to properly dispose of.

It will be understood that various details of the invention may be changed without departing from the scope of the invention. Furthermore, the foregoing description is for the purpose of illustration only, and not for the purpose of limitation—the invention being defined by the claims.

What is claimed is:

1. A method for burning land clearing debris and the like which have been collected together comprising:

directing an air current onto said burning debris with a mobile apparatus comprising a fan driven by a motor; and spraying a flammable fluid onto said pile of burning debris with a spray nozzle fluidly connected to a pump driven by a motor and a flammable fluid tank carried by said mobile apparatus, said flammable fluid comprising about 60 to 90 percent by weight motor oil and about 10 to 40 percent by weight diesel fuel;

whereby the flammable solution will adhere to the pile of burning debris and with the aid of the blower serve to expedite the complete combustion of the pile of burning debris.

* * * * *